United States Patent [19]

Fast

[11] Patent Number: 4,716,669

[45] Date of Patent: Jan. 5, 1988

[54] PRICE CHANNEL FLAG & POCKET

[76] Inventor: Jacob Fast, 7561 NW. 9th St., Plantation, Fla. 33317

[21] Appl. No.: 756,235

[22] Filed: Jul. 18, 1985

[51] Int. Cl.[4] ..... G09F 3/18

[52] U.S. Cl. ..... 40/16.2; 40/10 R

[58] Field of Search ..... 40/10 R, 10 D, 16.2, 40/16, 11 R; 248/220.2, 221.4

[56] References Cited

U.S. PATENT DOCUMENTS

| | | | |
|---|---|---|---|
| 754,503 | 3/1904 | Rubicam et al. . | |
| 2,755,576 | 7/1956 | Golden . | |
| 2,935,804 | 5/1960 | Duckro . | |
| 3,169,330 | 2/1965 | Deuchar . | |
| 3,214,122 | 10/1965 | Frederickson | 248/221.4 |
| 3,536,287 | 10/1970 | Kramer | 248/DIG. 9 |
| 3,753,305 | 8/1973 | Mueh | 40/16 |
| 3,774,328 | 11/1973 | Tanney . | |
| 4,094,415 | 6/1978 | Larson . | |
| 4,179,138 | 12/1979 | Bogdanovic | 248/221.4 |
| 4,477,048 | 10/1984 | Conway | 40/10 R |
| 4,483,502 | 11/1984 | Fast | 40/10 R |
| 4,537,310 | 8/1985 | Thul | 40/10 R |
| 4,541,598 | 9/1985 | Villanueva et al. | 248/221.4 |

FOREIGN PATENT DOCUMENTS

| | | | |
|---|---|---|---|
| 83/03319 | 9/1983 | PCT Int'l Appl. | 40/2 R |

OTHER PUBLICATIONS

Extracts from Aug. 1985 Price List of Fast Chemical Products Corporation.

*Primary Examiner*—Robert P. Swiatek
*Assistant Examiner*—Cary E. Stone
*Attorney, Agent, or Firm*—Holman & Stern

[57] ABSTRACT

Price channel flags for the display of merchandise information are provided with improved features whereby such flags may be adequately retained in price channels which are somewhat wider than the nominal price channel width, and whereby replacement labels may be used in a depending pocket portion of a price channel flag which is adequately supported by the price channel to allow a bar code on a label received therein to be adequately read by a bar code reader.

6 Claims, 5 Drawing Figures

PRICE CHANNEL FLAG & POCKET

BACKGROUND OF THE INVENTION

This invention relates generally to the labeling of merchandise on store shelves and the like, for example to display a product price, a bar code, or other merchandise information. More particularly, the invention relates to label holders of the type adapted to fit in so called "price channels" commonly provided on the front of supermarket shelves and the like.

A price channel may, for example, be located along, or form the front edge of a supermarket or like product display shelf, and may be a metal extrusion of generally arcurate concave cross section with upper and lower retention lips. To display product information in such channels, use is made of price channel flags which are rectangular cards of resilient sheet material, such as plastic sheet, which are slightly wider than the channel and which are flexed into concave form and snapped into the channel to be retained therein by engagement of the upper and lower edges of the card against the upper and lower channel lips. It is also known for price channel flags to have a depending portion which projects below the price channel to carry additional product information, promotional material, and the like.

Known price channel flags, however, suffer from certain disadvantages. For example, price channels, although generally of standard nominal width, may in fact vary somewhat in width, so that a flag sized to fit a nominal width channel may be too small for a somewhat overwidth channel, and not be adequately retained therein. Further the marking of price channel flags with product information is commonly by way of direct adhesion and there is generally no facility for using replaceable reusable price labels with such flags. Another drawback of flags which incorporate a depending portion is that if the depending portion carries a bar code, it may not be sufficiently well supported to be properly read by a bar code reader since it hangs freely beneath the price channel.

The present invention is directed toward the provision of a price channel flag structure which is an improvement over the prior art devices in the above respects.

SUMMARY OF THE INVENTION

One aspect of the invention resides in forming a price channel locating portion of a price channel flag of greater height than the regular oversize height required to provide a sufficient grip in a price channel of nominal width when the card is flexed into concave form, and providing said portion of the flag with a transverse bend line adjacent one of the top and bottom edges, forming a flexible edge portion adapted to be flexed relative to the main body of said portion to a greater or lesser extent so as to adjust the effective height of said portion to suit price channels having irregularities in width beyond the nominal width. Thus, the fitting problem previously referred to is to a great extent overcome.

Another aspect of the invention resides in forming the dependent portion of a price channel flag as a two-panel fold-over pocket with tabs at the ends of its free edge which, when the pocket is folded, fit against the lower lip of the price channel. The tabs thus provide support for the depending portion of the flag sufficient for use therewith of a bar code reader. Further, the pocket construction of the depending portion of the flag permits of the ready replacement of labels therein.

The two aspects of the invention may both be incorporated in combination in a price channel flag or may be used separately.

Additional features and advantages of the invention will be apparent from the following description and claims read in conjunction with the accompanying drawings.

DESCRIPTION OF PREFERRED EMBODIMENT

Figure 1:
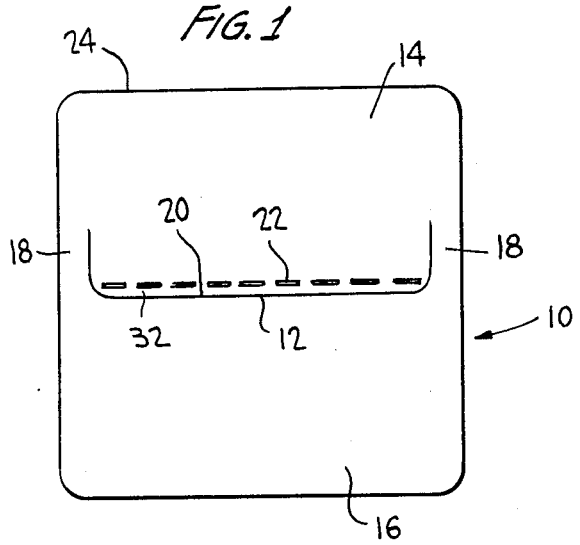
FIG. 1 is an elevational view of a first form of price channel flag in accordance with the invention.

Referring initially to FIG. 1, there is illustrated a first form of price channel flag 10 in accordance with the invention formed from a rectangular card of plastic sheet or like material having a die-cut or like channel-shaped slit 12 dividing the card into an upper price-channel engaging portion 14 and a lower depending portion 16 joined to the upper portion by limbs 18. Adjacent the lower edge 20 of portion 14 the flag is formed with a transverse score or bend line 22.

Figure 2:
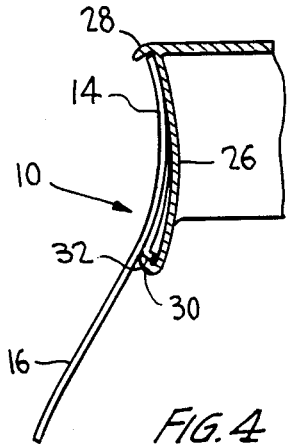
FIG. 2 is an end view of the flag shown in operative position in a price channel.

The height of portion 14 of the flag between bend line 22 and its upper edge 24 is the regular oversize height which is used for flags of this type when made to fit in a nominal width price channel 26 by flexing of the flag to snap it into the channel between upper and lower channel retention lips 28, 30. Thus, in channels which are exactly of nominal width, edge portion 32 of the flag between bend line 22 and edge 20 is flexed about the bend line as shown in FIG. 2 for accomodation in the channel. The presence of the flexed edge portion, however, allows the overall height of portion 14 of the flag to be adjusted so that it will also be retained in somewhat oversized price channels.

As shown in FIG. 2, depending portion 16 of the flag hangs below the price channel in a substantially unsupported manner. Accordingly, difficulty may be experienced in reading a bar code with a bar code reader, if such bar code were provided on the depending portion of the flag, for example by way of an adhesive label. Thus, while flags of the type shown in FIGS. 1 and 2 may be perfectly adequate for use where bar codes are not required, if a flag is to be used in conjunction with a label carrying a bar code in the depending portion, a construction as shown in FIGS. 3–5 is preferred.

Figure 3:
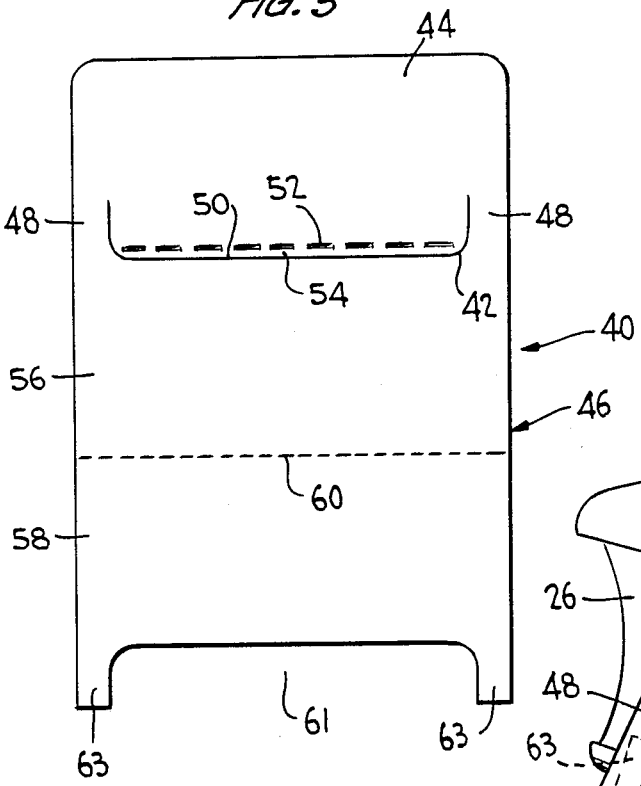
FIG. 3 is an elevational view of a second form of price channel flag in accordance with the invention.

As shown, therefore, in FIG. 3, a second form of price channel flag 40 in accordance with the invention is formed from a larger rectangular card or the like of the plastic material, and again has a channel shaped die-cut or like slit 42 dividing the flag into an upper price-channel-retention portion 44 and a lower depending portion 46 joined to the upper portion by limbs 48. A bend line 52 is again provided adjacent the lower edge 50 of the upper portion to provide a flexible height-adjusting lower edge portion 54 in like manner to the previous embodiment. In this case, however, the lower depending portion 46 of the flag is substantilly twice the height of the depending protion 16 of the previous embodiment, so as to define a pair of equal-height panels 56, 58 which can be folded about a central bend line 60 to form a receiving pocket for a label 62 as shown in FIGS. 4 and 5. Also, the lowermost edge of the depending portion is formed with a cutout 61 which is substantially a mirror image of slit 42 and defines a pair of tabs 63 at opposite corners of the flag.

Figure 4:
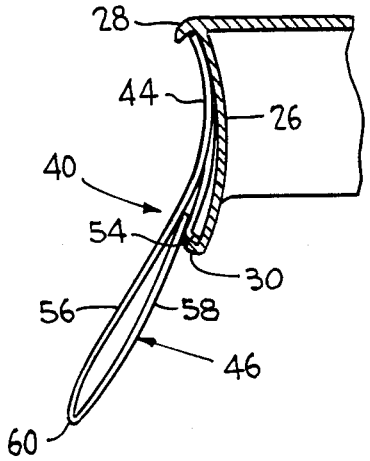
FIG. 4 is an end view of the second form of flag shown in operative position in a price channel.
Figure 5:
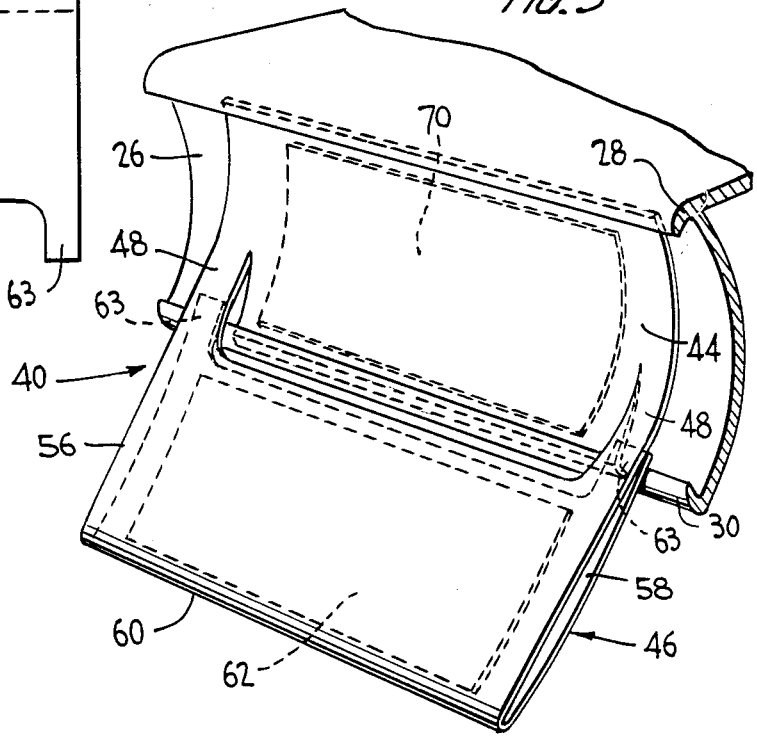
FIG. 5 is an enlarged perspective view of the second form of flag in the price channel.

When portion 46 of the flag is folded as shown in FIGS. 4 and 5, tabs 63 are supported against lower lip 30 of price channel 26 to provide support for the label-receiving pocket 16, so that if label 62 carries a bar code, it may be read by a bar code reader with the label being adequately supported. FIG. 5 also shows a label 70 which may be adhered to or placed behind portion 44 of the flag.

The folded pocket-like configuration of depending portion 46 of the flag allows label 62 to be readily replaced if required.

While only preferred embodiments of the invention have been described herein in detail, the invention is not limited thereby and modifications can be made within the scope of the attached claims.

I claim:

1. A price channel flag comprising a card of resilient sheet material having at least a rectangular price channel-engaging portion with an upper edge and a lower edge and a transverse bend line extending across the entire width of the price-channel-engaging portion adjacent one of the said edges, the distance between the bend line and the other of said edges conforming to the size of the regular oversize price channel flag adapted to be flexed into concave form so as to be retained in a substantially conforming concave price channel of nominal width, said bend line defining a flag portion between the bend line and said one edge for flexing about the bend line so as to make the flag adjustable in height for retention in price channels somewhat wider than the nominal width, wherein the flag includes a depending portion, a channel shaped slit defining the lower edge of the price channel-engaging portion and limbs at opposite ends of the slit connecting said portions, wherein the depending portion comprises a two-panel sheet with a fold line between the respective panels for forming the depending portion into a pocket-like configuration, and wherein the lower edge of the depending portion is formed with a cutout which is substantially a mirror image of the channel shaped slit and defines respective tabs at the ends thereof for supporting the depending portion against a price channel when folded into the pocket-like configuration.

2. The invention of claim 1 wherein the bend line is formed adjacent the lower edge of the price channel-engaging portion.

3. The invention of claim 1 wherein the depending portion comprises a single-panel sheet.

4. A price channel flag comprising a rectangular card of resilient sheet material divided by a transverse channel shaped slit into an upper price channel-engaging portion and a lower depending portion connected to the upper portion by respective limbs at opposite ends of the slit, the depending portion comprising a pair of panels connected by a transverse bend line and the depending portion having a lower edge defining a cutout which is substantially a mirror image of the slit and which defines respective tabs at opposite ends thereof.

5. The invention of claim 4 wherein the upper portion of the flag has a fold line adjacent one of an upper and lower edge thereof for adjusting the effective height of said upper portion.

6. In combination with a price channel of generally concave form having upper and lower tag-retaining lips, a tag for providing product information, the tag comprising a card of resilient sheet material flexed into substantially conforming concave form in the channel, the tag having a transverse fold line adjacent one of an upper and lower edge thereof about which fold line the tag is bent to provide a flexed portion engaging one of said channel lips, wherein the tag has a dependent portion projecting below the price channel, the dependent portion being connected to the card by respective limbs at opposite sides of the card, and wherein the dependent portion comprises a pair of panels folded into a pocket-like configuration for receiving a product label, one of said panels terminating in a free edge defining tabs at opposite ends thereof supported against a lower lip of the price channel behind the other of said panels.

* * * * *